United States Patent [19]

Tuttle

[11] 4,440,114

[45] Apr. 3, 1984

[54] BIAS BELLOWS FOR THERMOHYDRAULIC FEEDWATER REGULATOR

[75] Inventor: Douglas J. Tuttle, Marblehead, Mass.

[73] Assignee: Babcock & Wilcox Company, New Orleans, La.

[21] Appl. No.: 485,772

[22] Filed: Apr. 18, 1983

[51] Int. Cl.[3] ..... F22D 5/26

[52] U.S. Cl. ..... 122/451.2; 137/12

[58] Field of Search ..... 122/451.1, 451.2; 137/12, 455

[56] References Cited

U.S. PATENT DOCUMENTS

| | | | |
|---|---|---|---|
| 1,979,299 | 11/1934 | Veenschoten | 122/451.2 X |
| 1,995,237 | 3/1935 | Barrett | 122/451.2 |
| 2,057,172 | 10/1936 | Veenschoten | 122/451.2 |
| 2,800,887 | 7/1957 | Profos | 122/451.2 X |

*Primary Examiner*—Edward G. Favors

*Attorney, Agent, or Firm*—Vytas R. Matas; Robert J. Edwards

[57] ABSTRACT

A feedwater regulator for controlling the water level in a steam drum comprises a bellows defining a variable space connected to a connecting tube connecting a generator with the control element of a feedwater regulating valve. The generator is formed of concentric inner and outer tubes that are inclined with respect to the horizontal. An upper end of the inner tube is connected to the steam space of the steam drum with the lower end being connected to the water space of the steam drum. The outer tube defines a control space with the inner tube which is filled with water. The control space is connected to the control element of the regulating valve over the connecting tube. A decrease in water level pressurizes the water in the control space to open the regulating valve. The variable space of the bellows is set to a desired value and to adjust the overall relationship between regulating valve position and steam during water level.

14 Claims, 4 Drawing Figures

10
12'
12
12"
34
44
38
32
30
40
42
36
46
50
48
52
20
16
18
14

FIG. 2
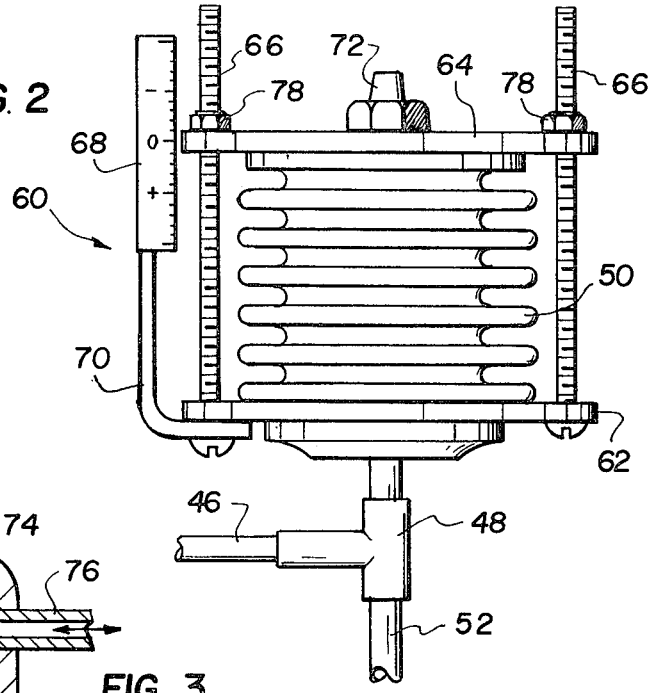
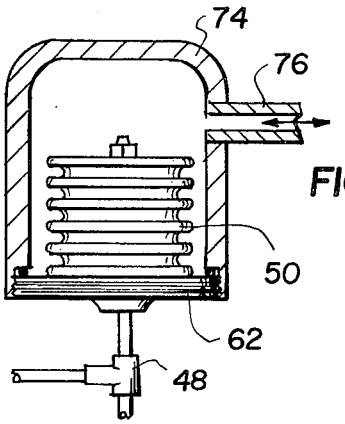
FIG. 3
FIG. 4
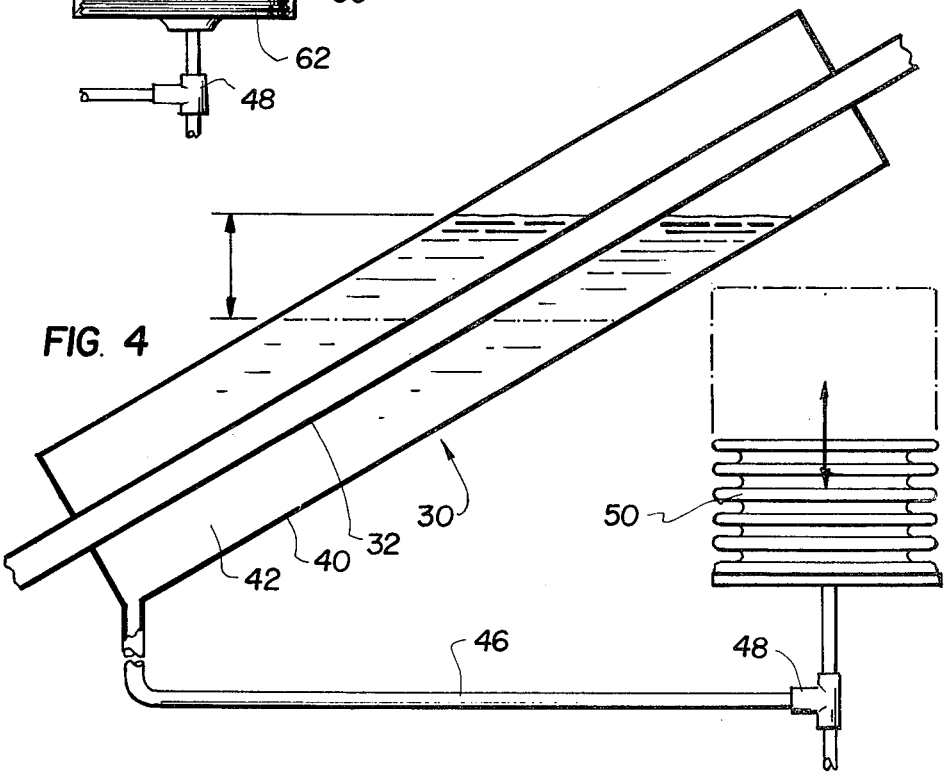

BIAS BELLOWS FOR THERMOHYDRAULIC FEEDWATER REGULATOR

FIELD AND BACKGROUND OF THE INVENTION

The present invention relates in general to feedwater level control for boilers and in particular to a new and useful thermohydraulic regulator which utilizes a bellows having a variable space to change the setting position for a feedwater regulating valve which regulates feedwater to a steam drum.

The control of feedwater using bellows in general is known as disclosed by U.S. Pat. No. 1,522,082 to Ruths. The use of bellows in controlling feedwater to a boiler is also known as disclosed in U.S. Pat. Nos. 3,952,031 to Schellens and 1,148,483 to Andrews.

In drum-type boilers, the purpose of feedwater control is to regulate the flow of water to the boiler so as to maintain a water level in the boiler drum between desired upper and lower limits. The control system varies with the type and capacity of the boiler as well as with the characteristics of the load.

Most shop-assembled boilers, in the low capacity range and the low operating pressure range, are equipped with self-contained feedwater control systems of the thermohydraulic or thermostatic type. The thermohydraulic type is generally applied to boilers having an operating pressure in the range between 60 and 600 psi and capacities not exceeding 75,000 to 100,000 lbs/hr. under steady state conditions.

The self operated feedwater regulator is actuated by a closed hydraulic system consisting of an annular control space between two concentric tubes. The control space is connected to a metal bellows of the feedwater regulating valve over connecting copper tubing. The concentric tubes, forming a generator, are inclined with respect to the horizontal. The control space extends between the upper and lower water level limits for the steam drum. An upper end of the inner tube of the generator is connected to the upper stream space of the steam drum with the lower end being connected to lower water space thereof.

The water level of the inner tube of the generator follows the actual level in the drum. When the water level in the drum decreases, heat from the steam in that portion of the inner tube vacated by the drop in water level, causes water in the control space of the outer tube to flash into steam. This displaces water from the control space through the connecting tubing into the metal bellows. This causes the bellows to expand, increasing the regulating valve opening to admit more water to the drum.

In such thermohydraulic regulators, water input is controlled in proportion to drum level and not in accordance with load. As a result, the level maintained at higher loads will be somewhat lower than the level maintained at relatively lower loads. The amount of this regulated level variation will depend on the extent of the load variation, the size of the regulating valve and the incline of the generator with respect to the horizontal. The unregulated valve variation will depend on the extent of "swell and shrink" effects, drum pressure changes and supply water variations.

Thus, instead of being controlled exclusively by the thermohydraulic regulator, drum level is also a function of load and feedwater pressure. This poses a problem in controlling the overall position of the feedwater regulating valve with respect to a desired drum level. Some plants, for example, go to a reduced summer steam load which is far below the load ranges that the regulator was initially set for. Water must then be physically removed or added to the control space between the inner and outer tubes to correct for the different load range. This is difficult and there is always the question of just how much or how little water should be provided in the system. There is also the problem of trapping air in the system during the addition or removal of water.

For additional information on the control of such boilers, see Steam, 39th Ed., Babcock and Wilcox Co., 1978, pages 35-5 to 35-7.

SUMMARY OF THE INVENTION

An object of the present invention is to solve the problem of resetting the thermohydraulic regulator by providing an arrangement for adjusting the amount of water in the control space within the outer tube of the generator without requiring the physical addition or removal of water, and further without the possibility of trapping air in the system.

It is noted that while in general water is disclosed as the controlling fluid in the thermohydraulic regulator, any other suitable fluid can be utilized.

Another object of the present invention is to provide a water level regulator for a steam drum having a steam space and a water space, a feedwater line connected to the drum and a feedwater regulating valve in the line with a movable control element, comprising an inner tube which is inclined and has an upper end adapted for connection to steam space and a lower end adapted for connection to the water space, an outer tube connected around the inner tube and defining a control space therewith which extends across the upper and lower limits of the steam drum level, the control space adapted to receive a fluid which is pressurized upon reduction in drum level, a connecting tube connected to the control space and adapted to connect the control space to the control element of the regulating valve, a bellows defining a variable space connected to the connecting tube and biasing means connected to the bellows for changing the volume of the variable space to control an overall relative setting of the regulating valve control member with respect to the drum level.

A still further object of the invention is to provide such a regulator wherein the biasing means comprises a mechanical arrangement for squeezing the bellows to a selected height which includes a scale for indicating the bellows volume.

Another object of the invention is to provide a thermohydraulic feedwater regulator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a side elevational view showing the bias bellows with a mechanical biasing arrangement for changing the variable volume thereof;

FIG. 3 is a side elevational view, partially in section of anoter embodiment of biasing means; and FIG. 4 is a schematic illustration showing the change in fluid volume in the generator in accordance with changes in bellows position.

DESCRIPTION OF THE PREFERRED EMBODIMENTS

Figure 1:
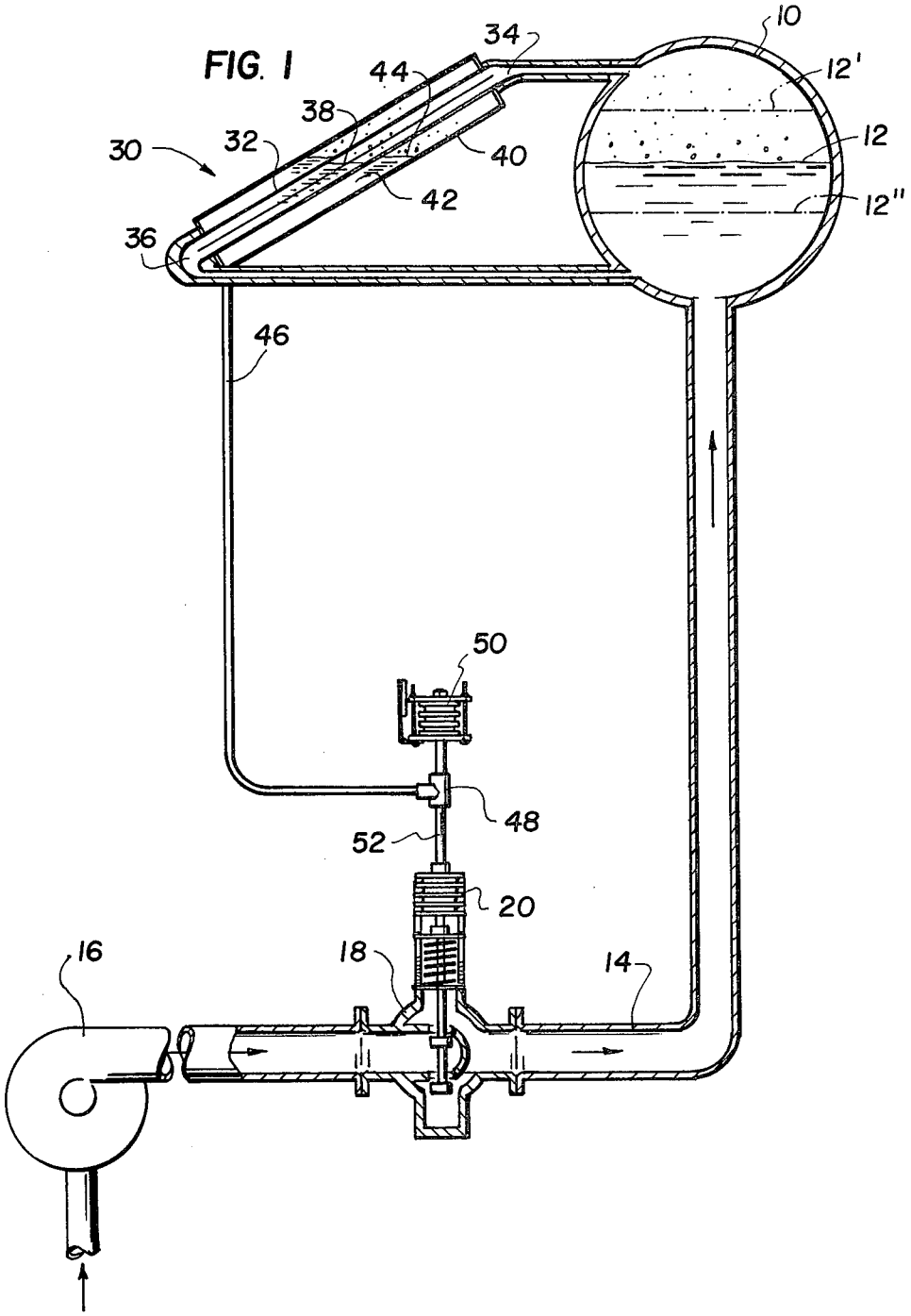
FIG. 1 is a representation of the inventive thermohydraulic feedwater regulator used in conjunction with the steam drum and feedwater supply arrangement for a small capacity, low-pressure, natural circulation boiler.

Referring to FIG. 1, the invention embodied therein comprises a thermohydraulic regulator for controlling or at least influencing the water level 12 of a steam drum 10 for a small capacity, low pressure, natural circulation, package boiler (not shown). Such boilers generally have an operating pressure range between 60 and 600 psi and a capacity not exceeding 75,000 to 100,000 lb/hr. under steady state conditions.

Water is fed to the drum 10 by a feedwater line 14 to which is connected a feedwater pump 16. A feedwater regulating valve 18 is provided in feedwater line 14 and includes a control element 20 generally in the form of a metal bellows.

The position of control element 20 is regulated by a generator generally designated 30 which comprises an inner tube 32 having an upper end 34 connected to the upper steam space of drum 10, and a lower end 36 connected to the lower water space of drum 10. In a normal state of quilibrium, the water level 38 of the water in tube 32 is the same as the water level in drum 10. The upper portion of tube 32 is filled with steam as is the steam space of drum 10.

An outer tube 40 surrounds inner tube 32 and defines with the inner tube an annular control space 42. The generator 30 is inclined with respect to the horizontal.

Water or other suitable fluid is contained within space 42. Space 42 is connected over connecting tube 46 to a T 48 which in turn is connected between a bellows 50 and a control line 52. Control line 52 is connected to space of control element or metal bellows 20 in valve 18.

In operation, when the drum level 12 falls, the level 38 of water in inner tube 32 also falls. The steam above level 32 heats the water in space 42 generating steam in an upper area of space 42 above water level 44. This pushes water through line 46 and 52 into control bellows 20 to open valve 18 and increase the flow of feed water on line 14 to drum 10. Conversely, when water level 12 rises, this causes a cooling of water in space 42 and a closing of valve 18 to reduce the flow of feedwater.

It is noted that space 42 and thus outer tube 40 spans the distance between an upper limit 12' and a lower limit 12" for the level of water in drum 10.

When the overall setting relationship between valve 18 and water level 12 is to modified (for example during summer use) rather than change the amount of water in space 42 and its connecting tubes 46, 52, the volume of bellows 50 is changed. This automatically changes the volume of heater in the control space without danger of admitting air or the inconvenience of having to open the control space.

As shown in FIG. 2, biasing means generally designated 60 are provided for mechanically changing the volume of bellows 50. These include a lower plate 62, an upper plate 64 and a pair of threaded rods 66 interconnecting the two plates. A bias scale 68 is provided as a visual indication of the bellows volume. Scale 68 is connected to the lower plate 62 over bracket 70.

A filling plug 72 is provided at the top of bellows 50 for adding or removing water or for tapping trapped air when necessary.

An alternate form of the biasing means is shown in FIG. 3, where a cover dome 74 is engaged over bellows 50 and sealably connected to lower plate 62. Elements having corresponding functions are represented with corresponding reference numerals.

To adjust the volume of bellows 50 from a remote location, a pressure line 76 communicates with a space defined by cover dome 74. The pressure on line 76 can be controlled by any known means with a pressure medium being incompressible such as a liquid or if appropriate compressible such as a gas.

FIG. 4 shows two extreme positions for bellows 50 in solid and chain line corresponding levels of fluid in control space 42. The volume of bellows 50 is advantageously selected to be about the same as a volume difference in control space 42 which represente a 4 inch change in water level in the drum of a small capacity boiler.

In FIG. 2 it is noted that the position of upper plate 64 is fixed with lock washers 78 threaded on rods 66.

While specific embodiments of the invention have been shown and described in detail to illustrate the application of the principles of the invention, it will be understood that the invention may be embodied without departing from such principle.

What is claimed is:

1. A water level regulator for a steam drum having a steam space, a water space, a feed water line and a feed water regulating valve in the feed water line with a movable control element, comprising:

an inclined inner tube having an upper end adapted for connection to the steam space and a lower end adapted for connection to the water space;

an inclined outer tube connected around said inner tube and defining a control space therewith extending across upper and lower limits of water level in the steam drum, said control space adapted to receive a volume of fluid which is pressurizable upon an increase of water level in the drum;

a connecting tube connected to said control space adapted to connect said control space to the regulating valve control element for passing fluid to move the control element;

a bias bellows defining a variable space connected to said connecting tube; and biasing means connected to said bias bellows for changing the volume of said variable space to change an overall setting relationship between the regulating valve control element and the steam drum water level.

2. A regulator according to claim 1, wherein said biasing means comprises means for mechanically squeezing said bias bellows to a selected height for changing the volume of fluid in said control space.

3. A regulator according to claim 2, wherein said means for mechanically squeezing comprises a lower plate connected to a lower end of said bias bellows, an upper plate connected to an upper end of said bias bellows, and at least one rod connected between said upper and lower plates.

4. A regulator according to claim 3, including scale means connected to one of said upper and lower plates and carrying a scale which indicates a degree of squeezing of said bellows in conjunction with the other of said upper and lower plates.

5. A regulator according to claim 4, wherein said scale means comprises a bracket fixed to said lower plate for carrying said scale, said scale extending vertically adjacent said upper plate.

6. A regulator according to claim 5, wherein said at least one rod is threaded, at least one additional rod connected between said upper and lower plates and a lock nut engaged on each rod for locking the position of said upper plate with respect to said lower plate.

7. A regulator according to claim 1, including a T-connection having a base connected to said connecting tube, one arm connected to said bellows and an opposite arm adapted for connection to the control element of the regulating valve.

8. A regulator according to claim 7, wherein the regulating valve includes a second bellows forming a control element, and a connecting line connected between said other arm of said T and said second bellows.

9. A regulator according to claim 1, including a cover dome connected over and enclosing said bellows and a pressure line connected to said cover dome for pressurizing a space defined between said cover dome and said bellows to vary the height of said bellows.

10. A regulator according to claim 9, wherein said bellows includes a base plate connected to said cover dome and a T having a base connected to said connecting tube, one arm connected to said bellows through said base and a second arm adapted for connection to the control element of the regulating valve.

11. In a thermohydraulic regulator for influencing a level of water in a steam drum having a steam space, a water space, a feedwater line and a feedwater regulating valve in the feedwater line having a control element for controlling the flow of feedwater in the feedwater line, and the thermohydraulic regulator including an inner tube having an upper end connected to the steam space with a lower end connected to the water space, an outer tube surrounding the inner tube and connected thereto to define a control space extending between upper and lower water level limits of the steam drum and connecting tubing connected between the control space and the control element of the feedwater regulating valve, the improvement comprising: a bellows defining a variable space connected to the connecting tubing and biasing means connected to the bellows for varying the variable space thereof to vary a volume of fluid in the control space.

12. In a theremohydraulic regulator according to claim 11, the improvement wherein said biasing means comprises upper and lower plates connected to opposite ends of said bellows, a plurality of spaced threaded rods extending between said upper and lower plates and at least one locking nut threaded on each rod for fixing a spacing between said upper and lower plates.

13. In a thermohydraulic regulator according to claim 12, the improvement including a bracket connected to one of said plates and a scale connected to said bracket and juxtaposed with the other of said plates for providing a visual indication of the relative position between said upper and lower plates.

14. In a thermohydraulic regulator according to claim 13, the improvement comprising a T having a base connected to the connecting tubing, one arm connected to said bellows and an opposite arm connected to the control element of the feedwater regulating valve.

* * * * *